US009328993B1

(12) United States Patent
Heacock

(10) Patent No.: US 9,328,993 B1
(45) Date of Patent: May 3, 2016

(54) GUN SIGHT

(71) Applicant: Lee Philip Heacock, Louisville, KY (US)

(72) Inventor: Lee Philip Heacock, Louisville, KY (US)

( * ) Notice: Subject to any disclaimer, the term of this patent is extended or adjusted under 35 U.S.C. 154(b) by 0 days.

(21) Appl. No.: 14/594,830

(22) Filed: Jan. 12, 2015

(51) Int. Cl.
*F41G 1/01* (2006.01)
*F41G 1/08* (2006.01)
*F41G 1/02* (2006.01)

(52) U.S. Cl.
CPC ... *F41G 1/02* (2013.01); *F41G 1/08* (2013.01)

(58) Field of Classification Search
CPC ..... F41G 1/00; F41G 1/01; F41G 1/02; F41G 1/06; F41G 1/08; F41G 1/10; F41G 1/12; F41G 1/14; F41G 1/17; F41G 1/42; F41G 1/425; F41G 3/00
USPC ..... 42/111, 132, 133, 144, 145, 141
See application file for complete search history.

(56) References Cited

U.S. PATENT DOCUMENTS

| | | | | | |
|---|---|---|---|---|---|
| 837,563 | A * | 12/1906 | Hartman | 42/144 |
| 1,406,620 | A * | 2/1922 | Dear | 42/142 |
| 1,421,553 | A * | 7/1922 | Pohl | 42/141 |
| 1,586,413 | A * | 5/1926 | Doornbos | 42/140 |
| 1,834,248 | A * | 12/1931 | Lorenzen | 42/130 |
| 2,741,029 | A * | 4/1956 | Councill | 42/141 |
| 3,058,222 | A * | 10/1962 | Patchett | 42/142 |
| 3,187,436 | A * | 6/1965 | Friedrichsmeier | 42/137 |
| 3,190,002 | A * | 6/1965 | Bliss | 33/228 |
| 3,698,092 | A * | 10/1972 | Rosenhan | 42/132 |
| 4,494,327 | A * | 1/1985 | Cullity | 42/132 |
| 4,850,113 | A * | 7/1989 | Doll | 42/130 |
| 4,967,642 | A * | 11/1990 | Mihaita | 89/126 |
| 5,065,519 | A * | 11/1991 | Bindon | 42/145 |
| D435,283 | S * | 12/2000 | Ling, Jr. | D22/109 |
| 6,216,351 | B1 * | 4/2001 | Flubacher et al. | 42/145 |
| 6,233,836 | B1 * | 5/2001 | Uhlmann et al. | 42/145 |
| 7,562,486 | B2 | 7/2009 | LoRocco | |
| 7,934,334 | B2 | 5/2011 | Kraft | |
| 8,037,634 | B2 | 10/2011 | Price | |
| 8,230,637 | B2 * | 7/2012 | Lamb | 42/145 |
| 8,245,433 | B1 * | 8/2012 | Smith | 42/112 |
| 8,635,800 | B2 * | 1/2014 | Glimpse et al. | 42/132 |
| 2004/0226213 | A1 * | 11/2004 | Woodbury | 42/140 |
| 2006/0137234 | A1 * | 6/2006 | Castagnozzi | 42/124 |
| 2006/0207157 | A1 * | 9/2006 | Keng | 42/132 |
| 2007/0074441 | A1 * | 4/2007 | Howe | 42/111 |
| 2010/0281751 | A1 * | 11/2010 | Humpert | 42/142 |
| 2011/0005119 | A1 * | 1/2011 | Neergaard et al. | 42/111 |
| 2011/0314721 | A1 * | 12/2011 | Lamb | 42/145 |
| 2013/0255129 | A1 * | 10/2013 | Curry | 42/144 |
| 2013/0263492 | A1 * | 10/2013 | Erdle | 42/145 |
| 2014/0047756 | A1 * | 2/2014 | Grossman et al. | 42/148 |
| 2014/0223797 | A1 * | 8/2014 | Bar Yona | 42/111 |

* cited by examiner

*Primary Examiner* — Bret Hayes
*Assistant Examiner* — Derrick Morgan
(74) *Attorney, Agent, or Firm* — Middleton Reutlinger

(57) ABSTRACT

A gun sight is provided having a rear sight including at least two apertures which are offset vertically and horizontally to correctly sight the gun relative to two perpendicular axes. A forward sight is also provided which corresponds to the at least first and second apertures of the rear sight. These features also offset vertically and horizontally to aid in fast acquisition and targeting. The user or shooter may learn to accurately fire the weapon and more easily acquire a target with less extensive training.

19 Claims, 7 Drawing Sheets

GUN SIGHT

STATEMENT REGARDING FEDERALLY SPONSORED RESEARCH

None.

REFERENCE TO SEQUENTIAL LISTING, ETC.

None.

CROSS-REFERENCES TO RELATED APPLICATIONS

None.

BACKGROUND

1. Field of the Invention

Present embodiments generally relate to a firearm having a gun sight which improves alignment. More specifically, present embodiments are related to a gun sight which aids to provide user feedback that the gun is aligned at a target properly and aids to maintain proper wrist angles of the user so that the gun may be fired more accurately.

2. Description of the Related Art

Traditional guns or firearms utilize target sighting systems including a front sight typically located at the muzzle or forward end of the gun and a rear sight located closer to the handle of the gun. These sighting devices may have visual indicators which are aligned with a target for purpose of aiming and subsequently firing the gun. The goal of the sighting or visual references is to fire the weapon as accurately as possible. One common form of sighting or alignment devices includes a front sight having a post and rear sight having a notch. The post is aligned in the notch when aiming the firearm so that the post fills the gap and the notch of the rear sight when the gun is pointed at the desired target.

However, despite this and other forms of targeting or sighting features, prior art devices still allow for some misalignment of the gun with the desired target. Often times this misalignment occurs in the user's wrist which may allow for pivoting or undesirable movement so that the gun becomes unaligned with the target. For example, the forward sight can become misaligned relative to the rear sight in a vertical direction or in left-right, lateral direction. Still further, the gun may alternatively rotate about an axis extending through the barrel and muzzle of the gun.

Another characteristic of the sight system is that by having multiple sights that can be illuminated, which facilitates and encourages shooting the gun with both eyes open. This is by far the preferred method of shooting as it allows the shooter to see not only the sights and the target but inherently see the surroundings and more importantly the area behind the target.

Many gun sights are formed of dark metallic material or in some instances, ceramic material, which may also be dark in color. When used in low-light situations, the targets are often difficult to perceive due to the lighting conditions and the color of the gun sight. While some luminous gun sights have been developed, the difficulty still arises that the previously described problems with movement of the user's wrist during aiming may lead to shots which are inaccurate.

It would be desirable to provide a sighting device which aids the user in knowing that the gun is correctly sighted for a specified target prior to firing at the target. It would also be desirable that the sighting device give fast feedback to a user that the gun may be moving out of proper aim.

The information included in this Background section of the specification, including any references cited herein and any description or discussion thereof, is included for technical reference purposes only and is not to be regarded subject matter by which the scope of the invention is to be bound.

SUMMARY

A gun sight is provided which allows for aiming at the rear sight and targeting through a forward sight which provides visual indication to aid in limiting wrist movement which causes inaccuracies in targeting and firing of the weapon. The forward sight includes a first sight feature and a second sight feature and the rear sight includes a first sight aperture and a second sight aperture which is offset a preselected vertical and horizontal distance from the first sight aperture. When utilized correctly, the gun is targeted such that vertical movement of the barrel is immediately noticed or side-to-side movement of the barrel is immediately noticed. Additionally, rotation of the weapon about an axis passing through the barrel and muzzle is also immediately noticed due to the sight features alignment in the sight apertures. Therefore, all of these factors may be limited or eliminated by use of the targeting system while allowing a shooter to more easily acquire a target.

According to some embodiments, a sight for a firearm comprises a forward sight toward a first end of a gun, a rear sight toward a second end of the gun. The rear sight has a first aperture and a second aperture, the second aperture may offset in two directions from the first aperture. The forward sight having a first sight feature and a second sight feature. The second aperture may be substantially related in relative viewing size to the second sight feature. The first and second sight features may differ in at least one characteristic.

Optionally, the rear sight may have three apertures wherein the three apertures include a first primary aperture and two secondary apertures. The second sight feature may substantially fill the second aperture. The three apertures may form a triangular shape. The first and second apertures may have an axial length. The first sight feature and the second sight feature may be of different color. The first sight feature and the second sight feature may be of different size. The first sight feature and the second sight feature may be of different shape. The first aperture may be larger than the second aperture.

According to some embodiments, a gun sight comprises a forward sight and a rear sight, the rear sight having sight apertures which sight-in sight features on the forward sight when targeting a gun. The sight apertures may include a primary aperture and a secondary aperture. The sight features defining a primary feature and a secondary feature corresponding to the primary and secondary apertures. The gun sight correcting targeting with respect to two perpendicular axes.

Optionally, the sight features may be tritium sights. The tritium sight may comprise at least two colors.

In still a further embodiment, a gun sight for a firearm comprises a forward sight at one end of a gun and a rear sight at a second end of said gun. The rear sight may have first and second apertures which are offset in vertical and horizontal directions. The forward sight having first and second sight features which are viewable through the first and second apertures, respectively. The first sight feature may have a first size and the second sight feature may have a second size. The first and second apertures may have an axial length. One of the first and second sight features is sized to substantially fill at least one of the first and second apertures when targeting the gun. One of the first and second apertures substantially match the shape of corresponding one of said first and second sight features. The first sight having a first color and the second sight having a second color.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention is provided in the following written description of various embodiments of the invention, illustrated in the accompanying drawings, and defined in the appended claims.

BRIEF DESCRIPTION OF THE DRAWINGS

In order that the embodiments may be better understood, embodiments of a firearm having a gun sight to improve alignment will now be described by way of examples. These embodiments are not to limit the scope of the claims as other embodiments of the assembly will become apparent to one having ordinary skill in the art upon reading the instant description. Non-limiting examples of the present embodiments are shown in figures wherein:

DETAILED DESCRIPTION

Figure 1:
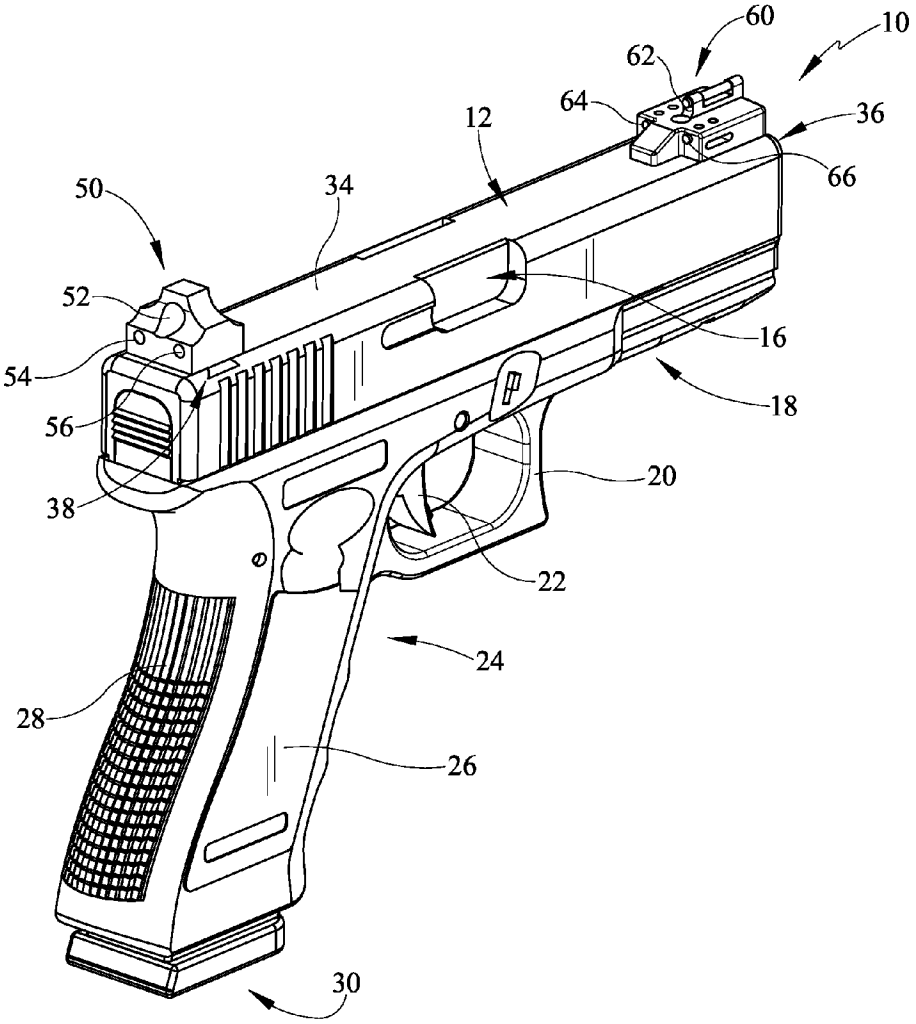
FIG. 1 is a perspective view of an exemplary firearm having one embodiment of a gun sight.

It is to be understood that the gun sight is not limited in its application to the details of construction and the arrangement of components set forth in the following description or illustrated in the drawings. The embodiments are capable of other embodiments and of being practiced or of being carried out in various ways. For example, one embodiment is capable of being combined with a second embodiment to create a further embodiment. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now in detail to the drawings, wherein like numerals indicate like elements throughout several views, there are shown in FIGS. 1-7, various embodiments of a gun sight. The gun sight utilizes a rear sight having at least two apertures which are offset vertically and horizontally to correctly sight a gun relative to two perpendicular axes. At a forward sight, there are also sight features which correspond to the at least first and second apertures of the rear sight. These features are also offset vertically and horizontally so that the gun is not tilted and offset in a vertical direction, or additionally is not moved in a right-to-left direction or laterally between the front and rear sights so as to misalign the gun with the intended target. The gun may additionally have more than two apertures and more than two sight features so that these aids may all be aligned for a quick reference to confirm to the user that the firearm is aimed correctly at an intended target. Thus the user or shooter may learn to accurately fire the weapon and more easily acquire a target with less extensive training.

Referring now to FIG. 1, an isometric view of an exemplary firearm or gun 10 is depicted. While a hand gun is shown, it should be understood that other embodiments are capable of using the sights of the present embodiments. Shotguns, rifles, machine guns and other aimable weapons may utilize the sighting embodiments taught herein. The gun comprises a slide 12 which covers a muzzle 14 (FIG. 2) and barrel extending through the slide 12. The slide 12 includes an ejection port 16 for ejection of spent cartridge shells during firing of the gun 10 and movement of the slide 12 associated therewith. Beneath the slide 12 is a frame 18 which is generally located beneath and may partially surround the barrel of the gun 10. Depending from the frame 18 is a trigger guard 20 within which the trigger 22 is located. The trigger guard 20 inhibits a user from moving a finger around the trigger 22 and inadvertently discharging the gun 10. Depending from the rear of the gun 10 and specifically the frame 18, is a handle 24 which comprises a grip 26 along the sides of the handle 24 and a back strap 28 along the rear surface of the handle 24 to partially engage a user's palm and provide some grip feature there.

At the bottom of the handle 24, is a magazine 30. The magazine 30 is loaded with a number of bullets which move upwardly into the gun 10 and are fired before shells are ejected through ejection port 16.

The slide 12 comprises an upper surface 34, with a front or forward end 36 and a second or rear end 38. The second or rear end 38 includes a rear sight 50 including a first aperture 52 and at least a second aperture 54. The rear sight 50 may further comprise a third aperture 56 as depicted.

Near the opposite end of the slide 12 is the front sight 60. The front sight 60 includes a first sight feature 62 and at least a second sight feature 64. Similar to the rear sight, the front sight may also include a third sight feature 66. The sight features are aligned with the apertures of the rear sight 50 in the longitudinal direction of the gun 10 that is the direction between the front end 36 and the rear end 38. The first and second sight features 62, 64 have at least one differing characteristic, including but not limited to, size, shape, color, horizontal positioning, vertical positioning and the like. In the depicted embodiment, the sight features 62, 64 may be of the same size or alternatively may be of differing size.

The diameters of the first aperture 52 and the third aperture 56 may be sized so that when looking through the rear sight 50, the first sight feature 62 and the third sight feature 66 of the front sight both fit respectively entirely within the apertures 52, 56. The same applies for the second aperture 54 and second sight feature 64 which is not shown in this view. For example, the first sight aperture may be as small as 0.040" and be as large as 0.60". Additionally, the apertures 52, 54, 56 may be sized relative to the axial length of the rear sight, that is the length and the direction between the first end 36 and the second end 38 so that the sight features 62, 64, 66 of the front sight 60 move out of or complete or full view through the apertures 52, 54, 56 when the gun 10 is slightly misaligned with an intended target. For example, according to some embodiments such as hand guns, the diameter of the front sight features may be substantially related in relative viewing size to the rear sight apertures. In some embodiments, the diameter of the front sight features may be from about 80% to about 95% of the rear sight aperture. In some embodiments, the front sight feature may be about 90% of the diameter of the rear sight apertures. Within this range of about 80-95%, the front sight feature substantially fills the rear sight aperture. The higher the percentage of the front sight diameter to the rear aperture diameter, the lesser the amount of gun or wrist movement it will take to make the gun appear out of proper sighting or targeting. However, for guns with longer barrels, this size relationship may vary. Thus, if the distance between the front and rear sights change, the diameters may also be varied. Also, a relationship may be provided as well between the first aperture 52 and the first sight feature 62. The relationship may be within the range provided or alternatively may differ.

The first aperture 52 and second aperture 54 of the rear sight are offset from one another both vertically and horizontally. Additionally, the first and second sight features 62, 64 of the front sight are also offset vertically and horizontally and aligned with the apertures of the rear sight 50. This provides improved alignment and reduces rotation of the gun 10 between the front and rear ends about a vertical axis and about a horizontal axis which are perpendicular to an axis extending through the barrel of the gun 10.

Figure 2:
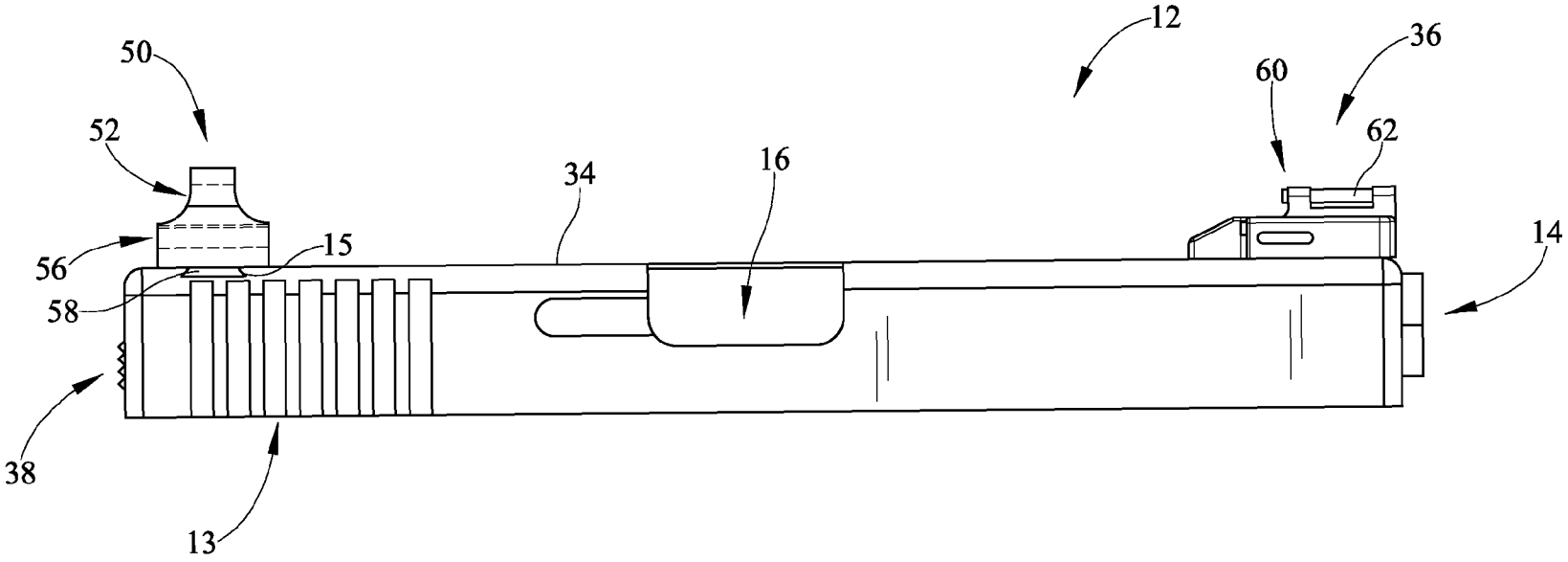
FIG. 2 is a side view of a gun slide including the front and rear sight.

Referring now to FIG. 2, a side view of the slide 12 is depicted. The rear sight 50 is shown at the second or rear end 38 of the slide 12, at the left hand end of the figure. The first or front end 36 is shown with the front sight 60 at the right hand end of the slide 12.

Referring first to the rear sight 50, the side view depicts the first aperture and third aperture 52, 56 in broken lines extending through the sight 50. The side view shows that the first aperture 52 is of a larger diameter than the third aperture 56. And, although not shown, the second aperture 54 may be parallel to the third aperture 56 or may be offset some vertical distance.

At the lower end of the rear sight 50 is a dovetail structure 58 which is positioned within a corresponding dovetail groove 15. The groove 15 is positioned above a slide grip 13 on the exemplary slide 12. The dovetail structure 58 and groove 15 may vary in shape. For example, an upside-down T may be used to retain the sight 50 in position. Other structural shapes and retaining features may be used to provide for desired adjustment and retaining of the sight 50.

Figure 3:
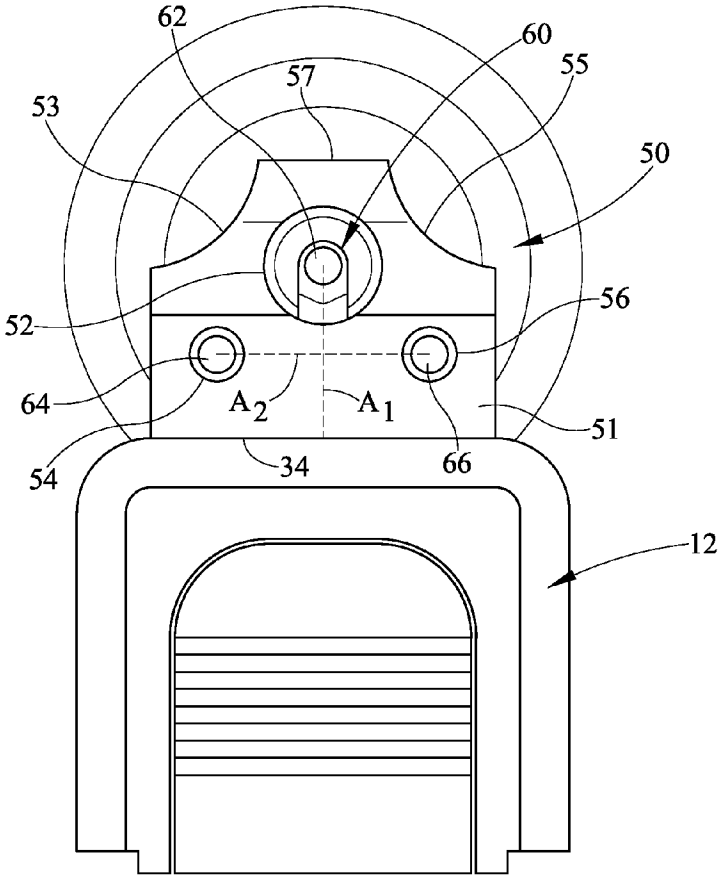
FIG. 3 is a rear view of the rear sight and portions of the front sight aimed at a target.

Referring now to FIG. 3, an end view of the gun 10 is depicted so that the rear sight 50 is shown and portions of the front sight 60 are shown through the rear sight 50. In the instant embodiment, the slide 12 is depicted from the rear end looking forward, in the manner as would be seen when firing the gun 10. The rear sight 50 has a base 51 wherein the second aperture 54 and the third aperture 56 are positioned. The base 51 extends vertically from the upper surface 34 of the slide 12 and then moves upwardly along surfaces 53, 55 to an upper surface 57. The surfaces 53, 55 are curved but may be angled rather than curved and the specific shape of the rear sight 50 is not limited such that other shapes may be utilized. The arrangement of apertures and sizes of such apertures may affect the shape of the rear sight 50.

Within the rear sight 50, is the first aperture 52. According to one embodiment, the first aperture 52 is larger in size than the second and third apertures 54 and 56 in order to aid in acquiring the target, also referred to as target acquisition. The second and third apertures 54, 56 are utilized to fine tune the impact location on the target. Additionally, the second and third apertures 54, 56 aid to improve aiming of the weapon 10 and limit wrist movement or other variables which may cause the bullet or projectile(s) to miss the intended target. Alternatively, in some embodiments, however, the first and second apertures 52, 54 may be the same size. Additionally, a first axis A1 is shown extending vertically through the first aperture 52 and a second axis A2 is shown extending between the second and third apertures 54, 56. This indicates that the second and third apertures 54, 56 are offset both vertically from the first aperture 52 and also, in a horizontal direction. It is desirable that the at least one second aperture 54 be offset vertically and horizontally from the first aperture 52. This provides improved alignment for targeting between the front and rear sights 50, 60.

Additionally, the shape of the apertures 52, 54, 56 are all shown as circular in shape. However, it may be that other shapes are utilized for some or all of the apertures 52, 54, 56. For example, the primary first aperture 52 may be circular while the second and third apertures 54, 56 could be alternate shapes, for example square, triangular, or other polygonal shapes. Still further, in some embodiments, each of the apertures 52, 54, 56 may be of different shape and all may be of different sizes or some apertures being the same size and others being different sizes, or still further, all being of the same size. In the instant embodiment, the first aperture 52 is of a first size and the second and third apertures 54, 56 are of a second size. Still further, as related to one another, the apertures 52, 54, 56 may be the same or differ in shape from the corresponding sight features 62, 64, 66. For example, as shown, the sight features 64, 66 are shown as the same shape as apertures 54, 56. However, the features may differ in shape than the corresponding apertures although it is desirable that some or all of the sight feature fit within the corresponding aperture during sighting of the weapon.

Additionally, and in combination with FIG. 2, the axial length of the apertures 52, 54, 56 may differ due to the curved surfaces between the base 51 and the upper surface 57. As shown in FIG. 1, the first aperture 52 may not appear completely round, as seen in FIG. 1, due to the aperture 52 extending through two or more surfaces of the rear sight 50. As shown in FIG. 2, the aperture 52 passes in part through a rear vertical surface and a curved surface extending upwardly from the rear surface. However, when viewed from the rear as shown in FIG. 3, the shape is perceived as circular. Further, the axial length depicted in FIG. 2 differs between the first aperture 52 and the second and third apertures 54, 56. Still further, however, the apertures 52, 54, 56 may also have shapes which are other than circular.

As seen from the rear end of the gun 10 through the rear sight 50, the front sight 60 is also partially shown. Specifically, a circular sight feature 62 is shown within the first primary aperture 52 of the rear sight 50. Similarly, the second and third sight features 64, 66 are also shown through the second and third apertures 54, 56 of the rear sight 50. The size of the sight features 62, 64, 66 is such that they all fit completely within the apertures 52, 54, 56, respectively. Further, the axial length of the at least second and third apertures 54, 56 is such that when the gun 10 is moved out of alignment front to back in either a left-to-right direction or a vertical direction, or still further if the gun 10 is slightly rotated about an axis extending through the barrel of the gun 10, the sight features 64, 66 exit the apertures 54, 56 either partially or completely. According to some embodiments, thickness in the axial direction may be about 0.050" but may be thicker as well for example up to about three inches (3"). One of the limiting factors for the lower limit of axial thickness of the first aperture 52 is how robust the rear sight 50 is. It is desirable that if the gun is dropped, the rear sight 50 not bend or break. However, for longer applications, the rear sight may have an axial dimension of up to about three inches (3").

Additionally, the arrangement of the sight features 62, 64, 66 and the apertures 52, 54, 56 may vary. In one depicted embodiment, the apertures and sight features each are arranged in a generally triangular shape. However, this is not limiting and other arrangements which may or may not define a geometric shape may be utilized. In these embodiments, at least two of the apertures and sight features are offset vertically and horizontally.

In the gun sight system, the size of the second sight feature 62 is related to the diameter of the first aperture 52. Similarly, the axial length of the first aperture 52 is related to the diameter of the first sight feature 62. The relationships of diameter and axial length of the second and third sight features 64, 66 to the diameter of the second and third sight features 54, 56. With respect to the dimensions of the sight system the aperture 52 has a diameter of about 225 thousandths of an inch (0.225") in diameter. The front sight feature 62 has a diameter of about 90 thousandths of an inch (0.090") in diameter. Second aperture 54 is 100 thousandths of an inch (0.100") in diameter. With regard to spacing of the apertures 54, 56, the centerline distance between apertures 54 and 56 is approximately four hundred and fifty thousandths (0.450") of an inch. Similarly, the centerline distance between the front sights 64, 66 is six hundred thousandths (0.600") of an inch. With reference additionally to FIG. 2 the rear sight 50 axial length, as measured through the first sight aperture 52, is approximately two hundred thousandths (0.200") of an inch. The rear sight axial length as measured at the second and third sight apertures 54, 56 is approximately five hundred thousandths (0.500") of an inch. Of course, these will change based on the application and as well as the length of the barrel/weapon upon which the sight system is applied.

The relative viewing size of the at least first and second apertures 52, 54 to the at least first and second sight features 62, 64 may also be related. The ratio of the size of the front sight features 62, 64, and 66 vary based on the application of the weapon. The two primary categories of application are close quarters (CQ) and long range target acquisition. The ratio displayed for the embodiment example was designed for an intermediate range of twenty-five feet (25'), the typical target distance that must be engaged to obtain a concealed carry permit. However, this is not to be considered limiting. For this distance, a ratio of about 0.5:1 is utilized for the front sight feature 62 diameter with respect to the rear sight aperture 52 diameter, in order to provide a large aperture for quick acquisition of the target. For other applications, such as long range target acquisition, a smaller ratio for sight aperture 52 could be utilized. For the second and third sight features 64, 66, a ratio of about 0.9:1 is utilized for front sight features 64, 66 to rear sight apertures 54, 56, allowing the front sight features 64, 66 to substantially fill the rear apertures 54, 56 providing both very accurate alignment of the weapon, as well as limiting the range of motion of the weapon to keep the front sights 64, 66 within the respective view of apertures 54, 56. Rear sight 50 axial length for sight aperture 52 is about 0.200", and the axial length for sight apertures 54, 56 is about 0.500". With this configuration, at twenty-five feet (25') the projectile point of impact (also called the field of view) can vary a maximum of about two and one-half inches (2.5") in both vertical and horizontal direction for a total impact range of five inches (5") as long as a portion of the sight features 64, 66 can still be observed in the rear apertures 54, 56. This field of view changes with the distance to the target. At a range of fifty feet (50') the field of view for the same configuration will be ten inches (10"), providing a linear relationship between the field of view and the distance to a given target. The axial length of the rear sight feature changes the field of view at a ratio of about 0.92:1. A two inch (2.0") axial length for rear aperture(s) 54 and 56 with a diameter of 0.300" at a distance of twenty-five feet (25') displays a field of view of approximately 13". An axial length of one inch (1") for the same aperture(s) at a distance of twenty-five feet (25') displays a field of view of approximately fourteen inches (14"), also creating a linear relationship for the axial length of the rear sight feature to the field of view at specific distances. The centerline distance (distance between the rear sight apertures from left to right) is adjusted based on the distance from the front sight feature to the rear sight feature. A longer weapon may require a longer distance, and the centerline must be closer in order to ensure the front sight features are centered within the rear sight feature apertures. Thus the axial lengths of the rear sight 50, as well as the diameter ratios of the second and third sight features and the centerline distances between the sights, can be adjusted to accommodate specific weapon lengths or applications such as CQ or long range target acquisition. CQ applications combine larger diameter to aperture ratio, with short axial rear sight length, and long range applications utilize small diameter to aperture ratio with longer axial length. The relationship of these parameters may be adjusted to fit a specific need, target distance or application.

Figure 4:
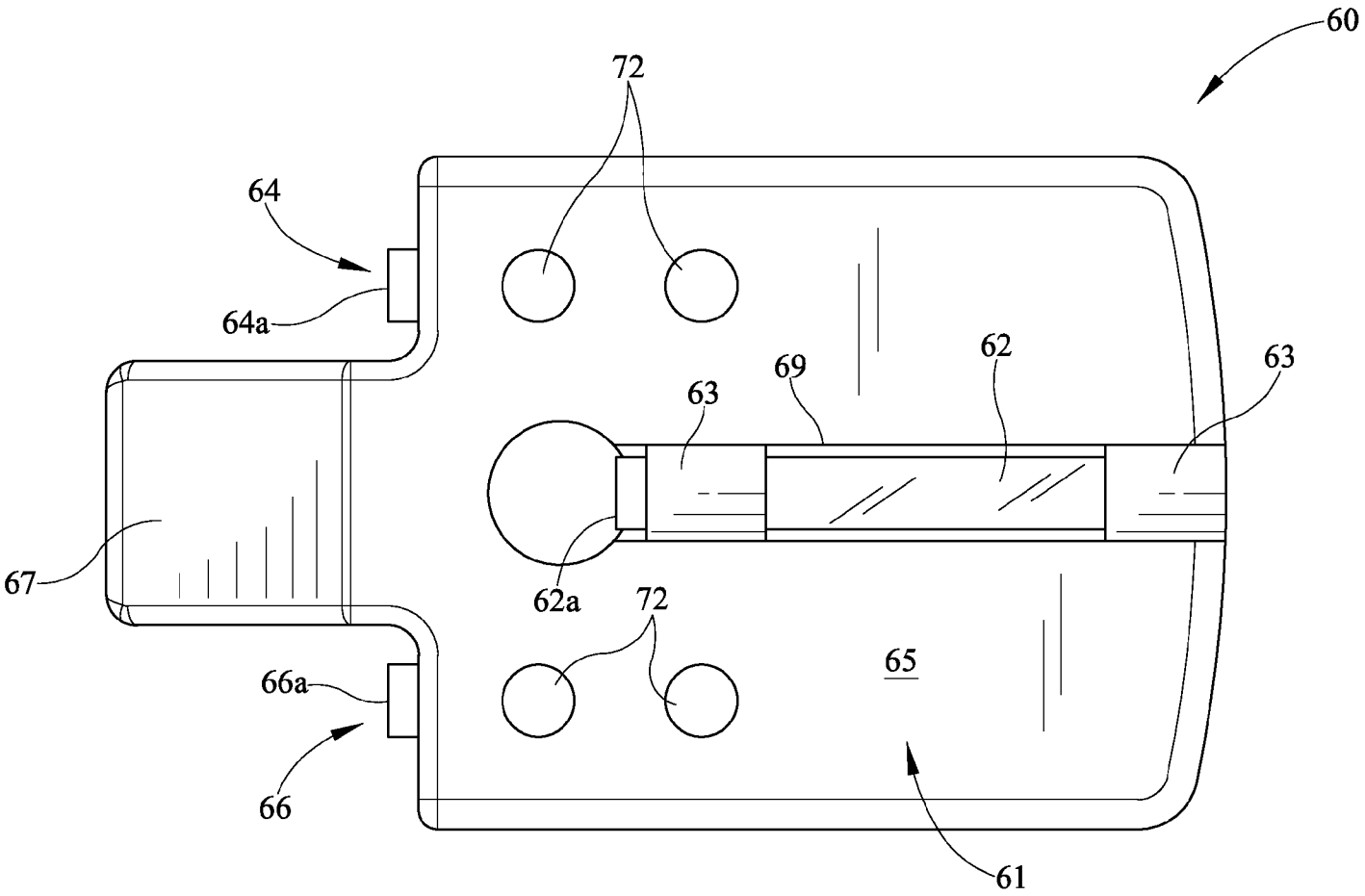
FIG. 4 is a top view of the front sight of the first embodiment of the gun sight.

Referring now to FIG. 4, the front sight 60 is shown in a top view. The front sight 60 includes a first sight feature 62 positioned above the base 61 of the front sight 60. The first sight feature 62 is held in position on a mount 69 by straps 63 which may or may not be integrally formed with the mount 69. The mount 69 may define various cross-sectional shapes when viewed from rear which correspond to the shape of the sight feature 62.

The base 61 has an upper surface 65 which tapers at a front surface 67 toward the upper surface 34 (FIG. 2) of the slide 12. The upper surface 65 may comprise windows 72 to show or indicate the second and third sight features 64, 66. Similarly, the space between straps 63 may also be illuminated by the first sight feature 62. Each of the sight features 62, 64, 66 comprises an end, 62*a*, 64*a* and 66*a*, respectively. The windows 72 and opening defined between straps 63 provide light to the sight features 62, 64, 66 which improve the luminosity of the sight features 62, 64, 66. More specifically, the ambient light is provided to a light pipe within the sight features 62, 64, 66 improving function.

Extending from the base 61 are the second and third sight features 64, 66. The ends 64*a*, 66*a* are visible along the front surface of the base 61. Similarly, the end 62*a* of the first sight feature 62 is visible in its elevated position on the mount 69. When viewed from the rear of the gun 10 looking forward, as shown in FIG. 3, these visible ends 62*a*, 64*a*, 66*a* are visible through the apertures 52, 54, 56.

In this view, it is clear that some embodiments may be formed wherein the second and third sight features 64, 66 are located in an offset manner (in the gun rearward direction) from the sight feature 62. However, in alternate embodiments, it is contemplated that the sight features 64, 66 may be located aligned with (in the gun forward-rearward direction) the first sight feature 62.

The sight features 62, 64, 66 may be formed of the same material as the remainder of the front sight 60 or may be formed of a different material. In some embodiments, the color of the sight features 62, 64, 66 may all be the same and in other embodiments, the features 62, 64, 66 may be of differing color for rapid target acquisition. For example, the color of the front sight 60 may be used, or the sight features 62, 64, 66 may be provided by, for example, paint, luminescent paint or other reflective material, all of which may be the same or differing color. Additionally, for example, in some embodiments, the sight features 62, 64, 66 may be formed of some luminous feature which is visible in low light or darkness. According to some examples, tritium features may be utilized to provide this illuminated sight feature which provides improved visibility in low/no light conditions improving the targeting of the gun 10 in these lighting conditions. When illuminated, sight features 62, 64, 66 provide several advantages. As mentioned previously, it is desirable to fire a weapon with both eyes open in order to sight the weapon while viewing the target. One way of encouraging this, and to more easily see the sight features 62, 64, 66 in low light conditions is to utilize the luminous sight features 62, 64, 66. This improves the eyes in finding the illuminated sight features through the rear sight 50. Further, the shooter knows that if all sights are visible, that the weapon is on target. Unexpectedly however, the shooter is able to learn more efficiently and become more proficient in the difficult task of learning to shoot a weapon with both eyes open. Additionally, as seen in FIG. 3, the sight features 62, 64, 66 are all circular corresponding to the shape of the apertures 52, 54, 56. However, as described with the apertures 52, 54, 56, the shape of the sight features 62, 64, 66 may vary and according to some embodiments, may be the same shape as the apertures 52, 54, 56 or according to other embodiments, may differ from the shape of the apertures 52, 54, 56. However, it is desirable that the features 62, 64, 66 all fit within the apertures 52, 54, 56.

Figure 5:
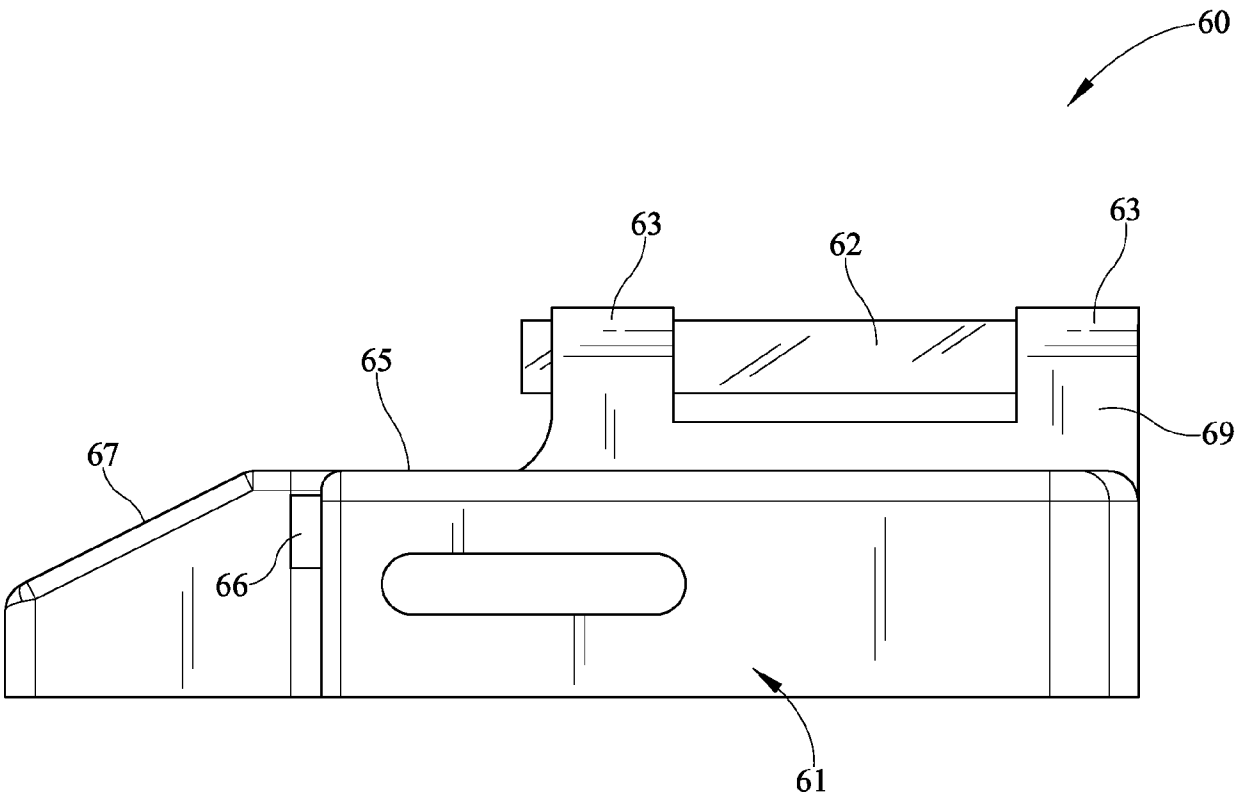
FIG. 5 is a side view of the front sight of FIG. 4.

Referring now to FIG. 5, a side view of the front sight 60 is depicted. The front sight 60 includes a base 61 having a plurality of vertical or angled surfaces including an upper surface 65 and a tapered front surface 67 at the forward end of the base 61. In this view, first sight feature 62 is shown positioned by straps 63 in the mount 69. The mount 69 extends from the upper surface 65 of the base 61 and provides a differential elevation between the first sight feature 62 and the second sight feature 64 (FIG. 4) and the third sight feature 66.

The front sight 60 includes a tapered front surface 67 for at least two reasons. First, the tapered front surface 67 inhibits snagging of the front sight during un-holstering of the weapon 10. Second, for aesthetic purposes, the tapered front surface 67 provides a sleeker, more desirable appearance. Further, it may be desirable to provide a taper on the leading edge of the straps 63 for these reasons. Additionally, the front surface 67 may be curved rather than tapered so as to provide the anti-snagging functionality. Alternate designs may be provided such as one, for example, wherein the front surface 67 is provided with a tapered or angled surface and a non-tapered surface, for example flat and/or curved.

It is also desirable to improve the unholstering of the gun 10 and therefore while the first sight feature 62 is elevated relative to the at least one second sight feature 64, 66, it is desirable that the vertical offset not be so high as to catch on a holster or other gear during unholstering of the weapon so that the gun 10 may be fired rapidly if a threat occurs quickly, or if the weapon is utilized in competition shooting requiring fast unholstering and firing of the weapon. Similarly, the rear sight 50 (FIG. 2) may have a tapered or curved surface to improve speed of unholstering.

Figure 6:
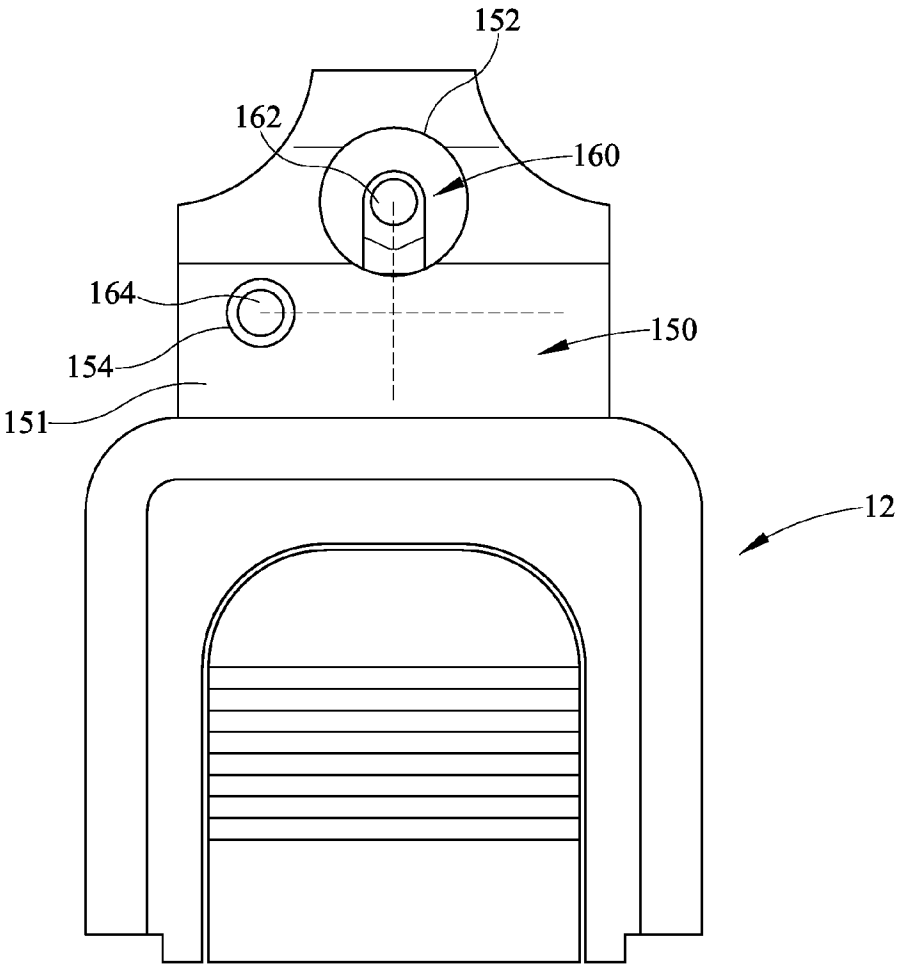
FIG. 6 is a rear view looking forward of the rear sight of an alternate embodiment of a gun sight; and, FIG. 7 is a rear isometric view of an exemplary gun slightly misdirected at a target.

Referring now to FIG. 6, an alternate embodiment is depicted in rear view looking forward. The gun slide 12 is shown with the rear sight 150 and portions of the front sight 160 through the rear sight 150. The rear sight 150 includes a base 151 and two apertures 152, 154. As with the previous embodiment, the apertures 152, 154 are of different size. The differing sizes allow the front sight 160 to be seen through the first aperture 152 as well as portions of the target being fired upon. Additionally, the second aperture 154 allows positioning of the second sight feature 164 to be seen through the second aperture completely. As with the previous embodiment, these apertures 152, 154 are shown to be circular in shape. In alternate embodiments, the apertures may be the same shape, the same size or may be differing shapes and differing sizes and the aperture shapes should not be considered limited to circular. It is desirable however, that the entire sight feature of the front sight 160 be viewable through the apertures 152, 154 of the rear sight 150 as in the previous embodiments.

Additionally, as shown in the embodiment, the apertures 152, 154 are offset both vertically and horizontally some distance. The offset allows for improved alignment and sighting of the gun 10 during firing, and further precludes the targeting of the weapon from being inaccurate by sizing at least the second sight feature 164 such that it completely fits within the second aperture 154 but is close in size to the aperture 154 when viewed through the rear sight 150.

Figure 7:
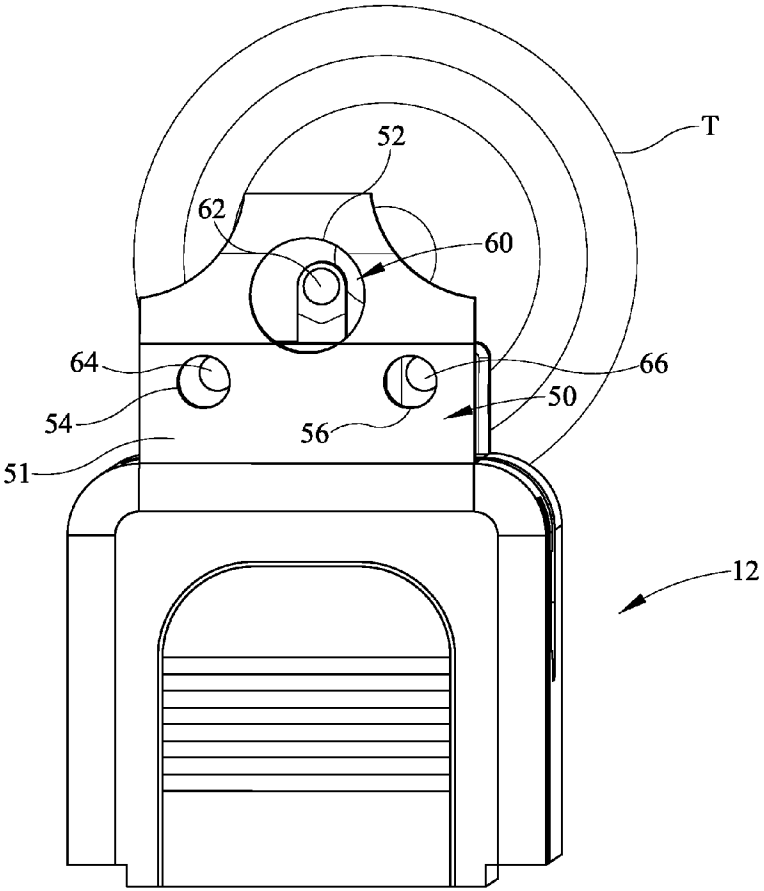

Referring now to FIG. 7, a rear view of the gun slide 12 is shown as depicted when firing the weapon at target T. In the depicted embodiment, the rear sight 50 is shown with portions of the forward sight 60 depicted through the apertures 52, 54, 56. The embodiment also shows the sight features 62, 64, 66 through the corresponding apertures 52, 54, 56. In the depicted embodiment, the gun, represented by the slide 12, is aiming at the target T but is not properly aimed. This is indicated by the sight features 64, 66 not being centered in the corresponding apertures 54, 56. Additionally, the primary or first sight feature 62 is not centered within the sight aperture 52. Therefore, if fired in this manner, the user will miss the bulls-eye or center area of the target T.

In operation, when the user views each of the sight apertures 52, 54, 56 individually through the rear sight 50, the user will immediately know that the gun 10 is slightly out of perfect alignment with target T. In this embodiment, the forward end of the gun should be brought downwardly and to the left slightly to lower the sight features 62, 64, 66 of the front sight 60 within the apertures 52, 54, 56 of the rear sight 50. Upon doing so, the gun 10 will be aligned with the desired targeted area.

Present embodiments allow for reduction of variables such as wrist position which may otherwise hinder shooting accuracy relative to the target. Further, present embodiments allow for aiming of the weapon with both eyes open, while also providing for faster target acquisition. Visualizing the illuminated sight features through the apertures encourages shooting with both eyes open which is otherwise difficult to teach to beginning shooters. As a result, the shooter not only sees the sights and the target but inherently sees the surroundings and the area behind the target.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

What is claimed is:

1. A sight for a firearm, comprising:

a forward sight toward a first end of a gun;

a rear sight toward a second end of said gun;

said rear sight having a first aperture and a second aperture, said second aperture being offset in two directions from said first aperture;

said forward sight having a first sight feature and a second sight feature both of which are simultaneously sighted in through said first and second apertures; of said rear sight, respectively, to aim relative to two axes;

said second aperture being substantially related in relative viewing size to said second sight feature; said first and second sight features differing in at least one characteristic.

2. The sight of claim 1, said rear sight having three apertures.

3. The sight of claim 2, said three apertures including a first primary aperture and two secondary apertures.

4. The sight of claim 2, said second sight feature substantially filling said second aperture.

5. The sight of claim 2, said three apertures forming a triangular shape.

6. The sight of claim 2, said forward sight having three sight features.

7. The sight of claim 1, said first and second apertures having an axial length.

8. The sight of claim 1, said first sight feature and said second sight feature being of different colors.

9. The sight of claim 1, said first sight feature and said second sight feature being of different sizes.

10. The sight of claim 1, said first sight feature and said second sight feature being of different shape.

11. The sight of claim 1, said first aperture being larger than said second aperture.

12. A gun sight, comprising:

a forward sight and a rear sight, said rear sight having sight apertures which sight-in primary and secondary sight features on said forward sight when targeting a gun;

said sight apertures including a primary aperture and a secondary aperture which are simultaneously sighted in with said primary and secondary sight features, respectively;

said forward and rear sights correcting said targeting with respect to two perpendicular axes.

13. The gun sight of claim 12, said sight features comprising tritium sights.

14. The gun sight of claim 13, said tritium sight comprising at least two colors.

15. A gun sight for a firearm, comprising:

a forward sight at one end of a gun and a rear sight at a second end of said gun;

said rear sight having first and second apertures which are offset in vertical and horizontal directions;

said forward sight having first and second sight features which are simultaneously sighted in through said first and second apertures, respectively when aiming said firearm;

said first sight feature having a first size; said second sight feature having a second size.

16. The gun sight of claim 15, said first and second apertures having an axial length.

17. The gun sight of claim 16 wherein one of said first and second sight features is sized to substantially fill at least one of said first and second apertures when targeting said gun.

18. The gun sight of claim 16, wherein one of said first and second apertures substantially matching a shape of corresponding one of said first and second sight features.

19. The gun sight of claim 15, said first sight having a first color and said second sight having a second color.

* * * * *